US005474478A

United States Patent [19]

Ballog

[11] Patent Number: 5,474,478

[45] Date of Patent: Dec. 12, 1995

[54] COAXIAL CABLE CONNECTOR

[76] Inventor: Joan G. Ballog, 1484 Mistaya Ct., Sunnyvale, Calif. 94087

[21] Appl. No.: 221,625

[22] Filed: Apr. 1, 1994

[51] Int. Cl.[6] ..... H01R 4/38

[52] U.S. Cl. ..... 439/805; 439/578

[58] Field of Search ..... 439/394, 578, 439/805–807

[56] References Cited

U.S. PATENT DOCUMENTS

| | | | |
|---|---|---|---|
| 4,648,683 | 3/1987 | Botka | 439/583 |
| 4,938,707 | 7/1990 | Guimond et al. | 439/578 |
| 5,127,843 | 7/1992 | Henry et al. | 439/320 |
| 5,127,853 | 7/1992 | McMills et al. | 439/578 |
| 5,131,861 | 7/1992 | Auclair et al. | 439/218 |
| 5,131,862 | 7/1992 | Gershfeld | 439/357 |
| 5,161,993 | 11/1992 | Leibfried, Jr. | 439/320 |
| 5,181,861 | 1/1993 | Gaver, Jr. et al. | 439/578 |
| 5,183,411 | 2/1993 | Yu | 439/578 |
| 5,183,417 | 2/1993 | Bools | 439/610 |
| 5,186,655 | 2/1993 | Glenday et al. | 439/583 |
| 5,195,906 | 3/1993 | Szegda | 439/394 |
| 5,259,790 | 11/1993 | Hayward | 439/578 |
| 5,344,333 | 9/1994 | Haag | 439/312 |

*Primary Examiner*—David L. Pirlot
*Assistant Examiner*—Jill Demello
*Attorney, Agent, or Firm*—Burns, Doane, Swecker & Mathis

[57] ABSTRACT

An improved coaxial cable end connector of the type having a tubular body having a front end portion, a rear end portion, a port attachment end associated with the front end portion for connecting the connector to a mating port, a sheath disposed about the front end portion and being threadingly engaged with an outer surface of the front end portion, and a cable attachment end having a threaded portion associated with the rear end portion for attaching the end connector to a coaxial cable, the improvement comprising grasping and rotating the sheath for attaching the end connector to the coaxial cable. The improvement enables using the sheath for more torque when grasping and threading the end connector onto the coaxial cable.

25 Claims, 3 Drawing Sheets

COAXIAL CABLE CONNECTOR

FIELD OF THE INVENTION

The present invention relates to connectors for coaxial cables, and more particularly to a connector that is manually installable on a coaxial cable without tools or special skills.

BACKGROUND

Coaxial cable is commonly used for distributing television and radio signals. The conventional coaxial cable consists of a central inner electrical conductor, usually made of aluminum or copper, surrounded by a dielectric insulator that is interposed between the inner electrical conductor and an outer electrical conductor. The outer electrical conductor is surrounded by a protective insulating jacket. The outer electrical conductor can comprise a sheath of fine braided metallic strands, a metallic foil, or multiple layer combinations of either or both. The dimensions of such coaxial cables may vary, depending upon type and source. Small diameter coaxial cables have been made available to the consumer. Typically either type RG-6 having a nominal overall diameter of about 0.275 inches (0.699 cm), or a type RG-59 having a nominal overall diameter of about 0.240 inches (0.609 cm).

Conventional coaxial cable end connectors are generally tubular in shape with a front end for connecting to a mating port and a rear end for receiving and connecting to the coaxial cable. The end connectors typically used for indoor service are known as "feed-through" connectors in the sense that the central inner electrical conductor of the coaxial cable extends through the end connector. The inner conductor is then engaged by a receptacle element (sometimes referred to as a center seizure mechanism) of the mating port mounted on such devices as a television set, a video cassette recorder, a FM stereo receiver, or the like.

Various feed-through connectors have been proposed for attaching to the end of prepared coaxial cables. For example, U.S. Pat. No. 5,195,906 ("Szegda"), which is incorporated herein in its entirety by reference, discloses an end connector having a tubular body with a port connecting end and a cable connecting end. The port connecting end has a locking sheath disposed about it which is adapted to lock the port connecting end to a mating port. The cable connecting end consists of interior, conventional (right-handed or clockwise) threads preceded by a non-threaded portion near the opening in the end of the cable connecting end. The connector is attached to a prepared coaxial cable by twisting the cable connecting end clockwise while pushing the connector down onto the cable. The drawback of the Szegda connector is that it is hard to grasp the cable connecting end and thread the connector onto the cable because of the small outer diameter of the cable connecting end.

U.S. Pat. No. 5,181,861 ("Gaver, Jr. et al.") discloses a manually installable end connector having a housing sleeve, a connector body having a plurality of serrations on fingers that extend longitudinally along the cable, and a locking ring. The connector is attached to a prepared coaxial cable by pushing the connector onto the cable, then sliding the housing sleeve backward in the direction of the cable to compress the serrations of the fingers into the cable and to engage the locking ring to hold the fingers in the cable.

U.S. Pat. No. 5,127,853 ("McMills et al.") discloses a feed-through connector having a tubular mandrel body dimensioned to be positioned between the dielectric insulator and the outer conductor of a prepared cable end. The body has a cable engagement surface comprising a conventional (right-handed or clockwise) set of threads which defines a knife edge projection around the body for engaging the outer conductor of the cable by creating shear stresses in the outer conductor without actually shearing the outer conductor. The connector is attached to the cable by turning the tubular body with a tool clockwise while pushing the connector down onto the cable so that the cable engagement surface of the tubular body burrows between the dielectric insulator and the outer conductor. Then the connector is locked in place by sliding a sleeve over the outside of the cable until it compresses the cable engagement surface of the tubular body between the dielectric insulator and the outer conductor.

In spite of the benefits of the above described coaxial cable connectors, there is a continuing need for a feed-through connector that is more easily installable by the consumer or installation craftsperson (i.e., installer) manually without tools or special skills. A cable television installer might have to install dozens of cable connectors in a day, especially if they have to make up cables that connect a video cassette recorder to a television (i.e., jumpers). The number of cable connectors installed can be hard on the fingers and possibly cause repetitive stress syndrome.

SUMMARY OF THE INVENTION

An object of the present invention is to provide a coaxial connector that is cost-effective, simple, and easily installable by the consumer or installer without tools or special skills. In particular, an object of the present invention is to provide a coaxial connector that can be grasped by a consumer or installer and easily threaded onto the end of a prepared coaxial cable.

A further object is to provide a connector that can be installed by the consumer or installer by grasping the larger diameter portion of the connector to twist the connector onto the cable to the proper installed position.

The present invention is an improved end connector of the type having a tubular body having a front end portion, a rear end portion, a port attachment means associated with the front end portion for connecting the connector to a mating port, and a cable attachment means having an interiorly threaded portion associated with the rear end portion for attaching the end connector to a coaxial cable. The port attachment means comprises a sheath disposed about the front end portion. The interior of the sheath is threadingly engaged with an outer surface of the front end portion with conventional threads. When the sheath is rotated clockwise, it moves from an unlocked position to a locked position so as to make the front end portion more rigid when the sheath is in the locked position.

In one embodiment of the present invention, the interiorly threaded portion associated with the rear end portion has reverse (e.g., counter-clockwise) turning threads. With this configuration of conventional threads in the sheath and reverse turning threads in the cable attachment portion, a significant improvement in the ability to attach the connector to a coaxial cable exists. The sheath can be rotated to its locked position, then the larger outer diameter of the sheath can be easily grasped and used to provide additional torque to thread the connector counter-clockwise onto the coaxial cable.

In another embodiment of the present invention, the threads on the interior of the sheath are continually engaged with the threads on the exterior of the front end portion of the connector and a stop is located behind the sheath on the exterior of the connector. With this configuration, there also exists a significant improvement in the ability to attach the connector to a coaxial cable. The sheath can be rotated until it abuts the stop, then the larger outer diameter of the sheath can be easily grasped and used to provide additional torque to thread the connector clockwise onto the coaxial cable.

In accordance with a preferred embodiment of the invention, an improved end connector is provided of the type having a tubular body having a front end portion, a rear end portion, a port attachment means associated with said front end portion for connecting said connector to a mating port, and a cable attachment means having an interiorly threaded portion associated with said rear end portion for attaching said end connector to a coaxial cable, the improvement comprising reverse turning threads in said interiorly threaded portion for attaching said end connector to the coaxial cable.

In another embodiment of the present invention, an improved end connector is provided of the type having a tubular body having a front end portion, a rear end portion, a port attachment means associated with said front end portion for connecting said connector to a mating port, a sheath disposed about said front end portion and threadingly engaged with an outer surface of said front end portion so as to be axially displaced along said front end portion between an unlocked position and a locked position so as to make said front end portion more rigid when said sheath is engaged in said locked position, and a cable attachment means having an interiorly threaded portion associated with said rear end portion for attaching said end connector to a coaxial cable, the improvement comprising reverse turning threads in said interiorly threaded portion for attaching said end connector to the coaxial cable.

In still another embodiment, an end connector is provided for connecting a coaxial cable to a mating port, comprising a tubular body having front and rear end portions, a port attachment means associated with said front end portion for attaching said end connector to the mating port, and a cable attachment means associated with said rear end portion for attaching said connector to the coaxial cable, said cable attachment means includes an interiorly threaded portion having reverse turning threads for attaching said end connector to the coaxial cable.

In yet another embodiment, an end connector for connecting a coaxial cable to a mating port, comprising a tubular body having front and rear end portions, a cable attachment means associated with said rear end portion for attaching said connector to said cable, said cable attachment means comprises an interiorly reverse-threaded portion of said tubular body which is preceded by a non-threaded interior portion of said tubular body that is adjacent a rear end opening at said rear end portion of said tubular body, a port attachment means associated with said front end portion for attaching said connector to said mating port, said port attachment means comprising a split ferrule defining a plurality of resilient fingers, and a sheath disposed about said front end portion of said tubular body, said sheath being threadingly engaged with an outer surface of said split ferrule so as to be axially displaced along said ferrule between an unlocked position and a locked position in which said sheath contacts said fingers, wherein said sheath is adapted to restrict the resiliency of said resilient fingers when engaged in said locked position.

In still another embodiment, an end connector for connecting a coaxial cable to a mating port, comprising a tubular body having front and rear end portions, a cable attachment means associated with said rear end portion for attaching said connector to said cable, said cable attachment means comprises an interiorly threaded portion of said tubular body which is preceded by a non-threaded interior portion of said tubular body that is adjacent a rear end opening at said rear end portion of said tubular body, a port attachment means associated with said front end portion for attaching said connector to said mating port, said port attachment means comprising a split ferrule defining a plurality of resilient fingers, and a sheath disposed about said front end portion of said tubular body, said sheath having threads that turn opposite from said interiorly threaded portion of said tubular body and being threadingly engaged with an outer surface of said split ferrule so as to be axially displaced along said ferrule between an unlocked position and a locked position in which said sheath contacts said fingers, wherein said sheath is adapted to restrict the resiliency of said resilient fingers when engaged in said locked position.

In yet another embodiment, an end connector is provided for connecting a coaxial cable to a mating port, comprising a tubular body having front and rear end portions, a cable attachment means associated with said rear end portion for attaching said connector to said cable, said cable attachment means comprises an interiorly threaded portion of said tubular body which is preceded by a non-threaded interior portion of said tubular body that is adjacent a rear end opening at said rear end portion of said tubular body, a port attachment means associated with said front end portion for attaching said connector to said mating port, said port attachment means comprising a split ferrule defining a plurality of resilient fingers, a sheath disposed about said front end portion of said tubular body, said sheath being continuously threadingly engaged with an outer surface of said split ferrule so as to be axially displaced along said ferrule between an unlocked position and a locked position in which said sheath contacts said fingers, wherein said sheath is adapted to restrict the resiliency of said resilient fingers when engaged in said locked position, and a stop member attached to said front end portion of said tubular body, said stop member abutting said sheath in said unlocked position, said stop member in combination with said continuous threaded engagement prevent said sheath from rotating freely.

In one of its method aspects, a method is provided for attaching an end connector of the type having a tubular body having a front end portion, a rear end portion, a port attachment means associated with said front end portion for connecting said connector to a mating port, a sheath disposed about said front end portion of said tubular body, said sheath having an interiorly threaded portion and being threadingly engaged with an outer surface of said split ferrule so as to be axially displaced along said ferrule between an unlocked position and a locked position, and a cable attachment means having an interiorly threaded portion having threads that turn opposite of said interiorly threaded portion of said sheath associated with said rear end portion for attaching said end connector to a coaxial cable, the method comprising the step of connecting said cable attachment means of said end connector to the coaxial cable by turning said sheath toward said locked position.

BRIEF DESCRIPTION OF THE DRAWINGS

The invention will now be described with reference to the accompanying drawings, in which.

DETAILED DESCRIPTION OF THE INVENTION

Figure 1:
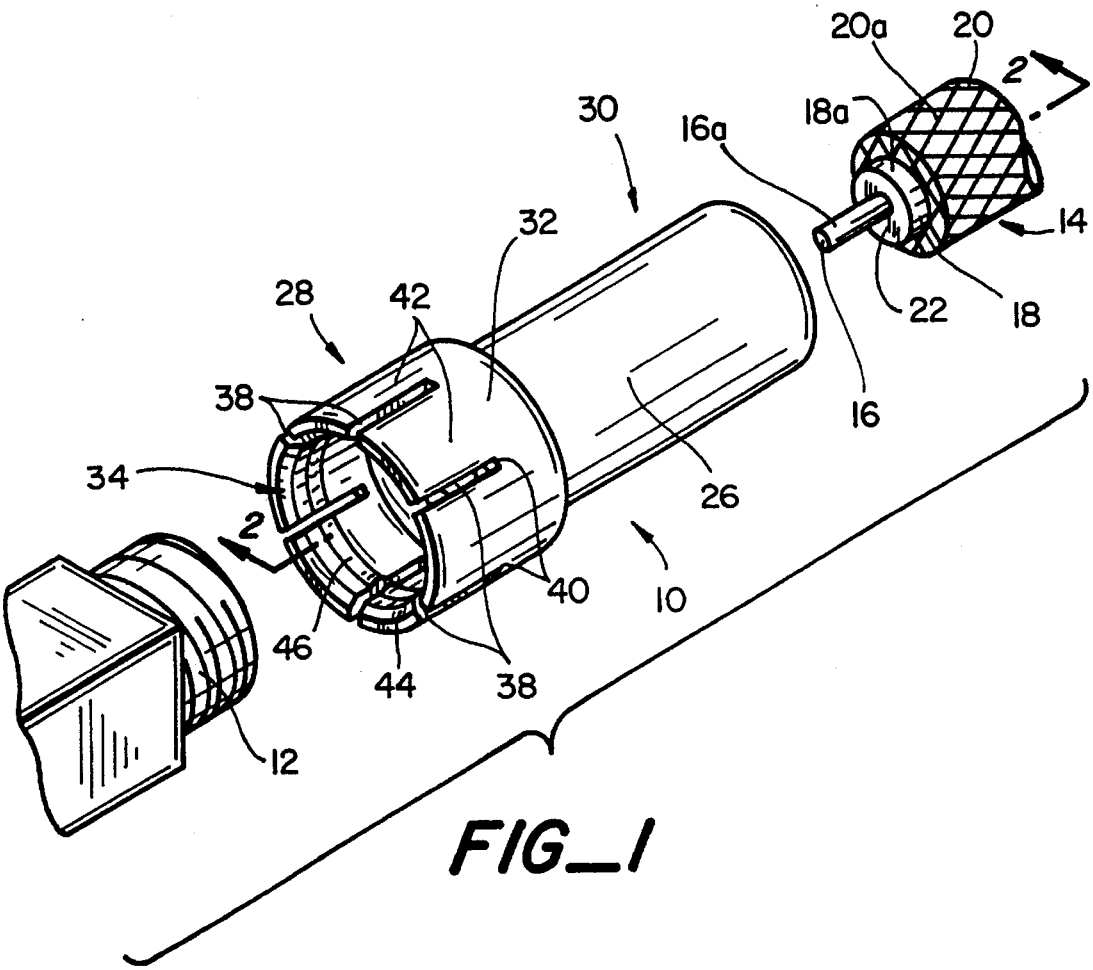
FIG. 1 is an exploded perspective view showing a conventional mating port, an end connector in accordance with the present invention, and an end of a conventional coaxial cable which has been prepared for insertion into the end connector.

Connectors, like the Szegda connector, have a sheath around the end that connects to a mating port. The sheath is threadingly engaged with the exterior of a split ferrule that comprises the end that connects to a mating port. The threads in the sheath are conventional threads. The sheath rotates freely if turned counter-clockwise and locks if turned clockwise.

This type of connector has a cable connecting end, opposite of the sheath, which has an interiorly threaded portion for threading the connector onto the cable. The interiorly threaded portion consists of conventional threads so that it is threaded onto the end of a prepared coaxial cable by gripping the cable connecting end and turning the connector clockwise. The problem with this type of connector is that the cable connecting end is relatively small in diameter and hard to hold when the connector is being threaded onto the cable.

The improvement in the present invention is a surprisingly simple solution to the problem. The improvement in one embodiment of the present invention over the Szegda type connector is that the sheath can be grasped and used to thread the connector onto the cable. To this end, in one embodiment the interiorly threaded portion of the cable connecting end of the connector has reverse (left-handed or counter-clockwise) threads. This rather small but very significant change provides a big advantage to the consumer or installer. By reversing the threads in the interior portion of the cable connecting end, the locking sheath, which has a larger diameter than the cable connecting end, can be used to thread the connector onto the cable.

The sheath can be rotated to its locked position and then easily grasped by the consumer or installer and used to thread the connector counter-clockwise down onto the cable. Then the sheath can be rotated back to its unlocked position and used for normal installation of the port mating end to a mating port.

The threads of the sheath and the threads in the interiorly threaded portion of the cable connecting end can be either conventional or reverse turning threads as long as they are opposite of each other in the end connector assembly and the sheath has a locking position in the corresponding direction of the threads. In other words, if the interiorly threaded portion is conventional threads, the threads of the sheath should be reverse turning threads and the sheath would lock when rotated counter-clockwise.

In another embodiment, the sheath is prevented from freely rotating when in an unlocked position. A stop is located behind the sheath on the front end portion of the connector such that the threads in the interior of the sheath are continually engaged with threads on the exterior of the front end portion of the connector when the sheath is rotated until it abuts the stop. By stopping the sheath such that the threads in the interior are continually engaged with the threads on the exterior of the front end portion of the connector, the sheath is not free to rotate. Therefore, the sheath, which has a larger diameter than the cable connecting end, can be used to thread the connector onto the cable.

The sheath can be rotated until it stops against the stop, then be easily grasped by the consumer or installer and used to thread the connector clockwise down onto the cable. Then the sheath can be rotated back to its locked position after the connector has been installed on the mating port. The threads of the sheath can be either conventional or reverse turning threads.

Figure 2:
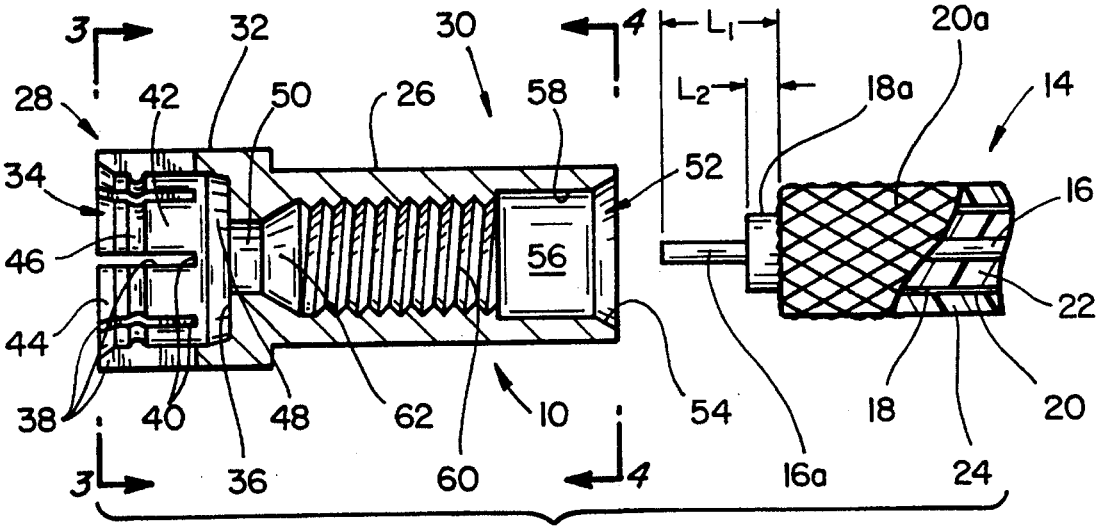
FIG. 2 is an enlarged sectional view taken along line 2—2 of FIG. 1.
Figure 3:
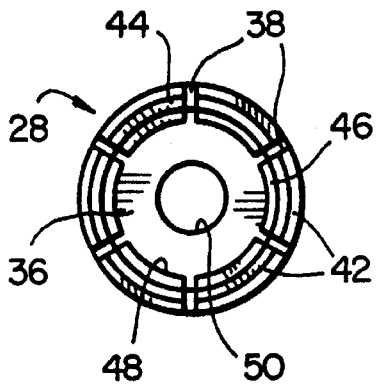
FIG. 3 is a sectional view taken along line 3—3 of FIG. 2.
Figure 4:
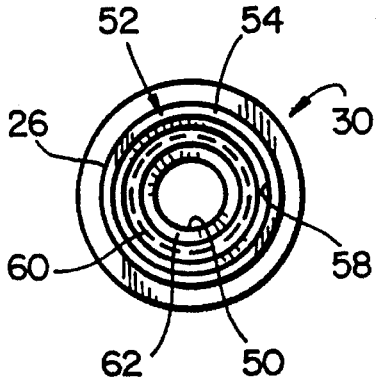
FIG. 4 is a sectional view taken along line 4—4 of FIG. 2.

Referring initially to FIGS. 1 and 2, an end connector 10 in accordance with the present invention is shown between a conventional externally threaded equipment mating port 12 and an end of a conventional coaxial cable 14 which has been prepared to receive the end connector 10.

The cable 14 includes an electrical inner conductor 16 surrounded by and spaced inwardly from an electrical outer conductor 18 comprising a layer of metallic foil directly underlying a layer of braided metallic mesh 20. The inner and outer conductors 16,18 are electrically isolated one from the other by a dielectric insulator 22 interposed between them. A dielectric protective covering or jacket 24 surrounds the outer conductor 18.

The end of the cable 14 is prepared for coupling with the end connector 10 by first removing length $L_1$ of the jacket 24 to thereby expose an end segment 20*a* of the braided metallic mesh. The exposed end segment 20*a* of mesh is then folded back over the jacket 24 as illustrated in the drawings, thus exposing an end segment 18*a* of the metallic foil of the electric outer conductor 18 and the underlying dielectric insulator 22. Thereafter, a shorter length $L_2$ of the exposed metallic foil of the electric outer conductor 18 and the underlying dielectric insulator 22 are removed to thereby expose an end segment 16*a* of the inner conductor 16.

In one embodiment of the present invention, the end connector 10 comprises a tubular body 26 having a front end portion 28 and a rear end portion 30. A split ferrule 32, which is adapted for attachment to the mating port 12, is provided at the front end portion 28 of the tubular body 26. The split ferrule 32 comprises an open end 34 for receiving the mating port 12 and a partially enclosed end 36. The split ferrule 32 also includes a plurality, e.g. six, of longitudinal slits 38 which extend from the open end 34 of the ferrule 32 to a base end 40 of the slit which is intermediate the open end 34 and the partially enclosed end 36 of the ferrule 32. The longitudinal slits 38 define a plurality of partially cylindrical resilient fingers 42 which compensate for size tolerances of the mating port 12.

Figure 5:
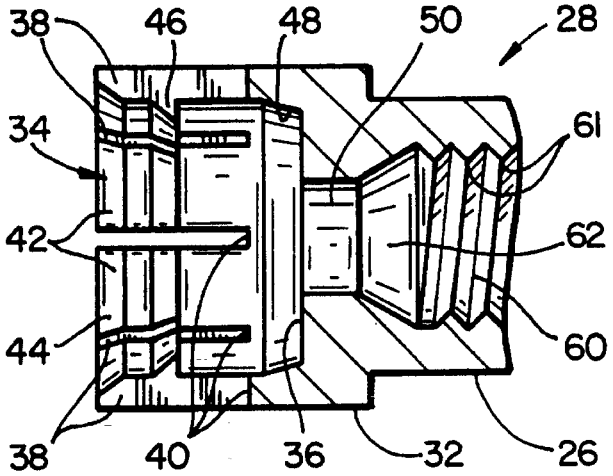
FIG. 5 is a partial sectional side view showing a portion of the port attachment means at the front end portion of the end connector and the internal threaded portion at the rear end portion of the end connector illustrated in FIG. 2.

In accordance with one embodiment of the present invention, each of the resilient fingers 42 is configured to include a slightly tapered portion 44 on the inside surfaces thereof at the open end of the ferrule 32 which also compensates for size tolerances of the mating port 12. Furthermore, the resilient fingers 42 are configured to have inward arcuate projections 46 which define a circumferential ridge that is adapted to engage either the flat or, preferably, the threaded surface of the equipment mating port 12. The circumferential ridge provides resistances to incidental disengagement of the end connector 10 from the mating port 12 due to external forces applied to the cable 14. The inward arcuate projections 46 may be configured as a radial or triangular protuberance, or as a ramp and edge projection as illustrated most clearly in FIG. 5.

In one embodiment of the present invention, the inner surface of the split ferrule 32 includes an inwardly tapered portion 48 which is defined between the base end 40 of the longitudinal slits 38 and the partially enclosed end 36 of the ferrule 32. The inwardly tapered portion 48 allows for metal to metal contact between the ferrule 32 and the mating port 12 when they become engaged, thus providing a solid contact which helps prevent signal loss or unwanted signal ingress (e.g., noise) from outside sources.

In accordance with one embodiment of the invention, the front end portion 28 also is provided with a through chamber 50 for communication with the rear end portion 30 of the tubular body 26. The rear end portion 30 includes a rear end opening 52 for receiving the prepared cable 14, and in one embodiment further defines a slightly tapered portion 54 which leads to an interior non-threaded chamber 56 which defines a smooth interior surface 58.

An interiorly threaded portion 60 is defined by the tubular body 26 disposed between the non-threaded chamber 56 and the through chamber 50 leading to the front end portion 28 and ferrule 32. An inwardly tapered portion 62 is provided to transition from the threaded portion 60 to the through chamber 50.

The tapered portion 54 and the smooth interior surface 58 of the non-threaded chamber 56 serve initially to guide the prepared cable 14 for connection to the end connector 10. More importantly, the non-threaded chamber 56 serves to cover the exposed metallic braided mesh 20 of the prepared cable 14 so that the user is not exposed to the fine sharp wire ends during the connection process. In addition, the non-threaded chamber 56 helps prevent the metallic braided mesh 20 from becoming lumped and thus impeding entry of the cable 14 into the threaded portion 60 and possibly causing damage to the cable 14. The interior surface 58 functions to smooth out the metallic braided mesh 20 in order to prevent tearing of the braided mesh and to enhance the ease of connection to the cable 14.

After the cable has entered the non-threaded chamber 56, the connector 10 is threaded onto the cable 14 with the interiorly threaded portion 60. The interiorly threaded portion 60 is comprised of a reverse threaded portion. In other words, the end connector 10 is rotated counter-clockwise to thread the end connector 10 onto the cable 10. The reverse threads are also known as left-handed or counter-clockwise turning threads. By twisting the connector 10 counterclockwise, the connector 10 is drawn onto the cable 14 by threaded action. The threaded portion 60 creates a mating thread in the pliable material of the jacket 24. The thread crests 61 are preferably sharp enough to penetrate into the surface of the cable jacket 24, yet not fracture the cable jacket or sever the wire braid of the outer conductor. It is believed that the pliable material of the jacket 24 flows into the threads to help provide an axial holding force on the cable 14. The end connector 10 is threaded onto the cable 14 until the exposed segment **16*a* of the inner conductor 16 protrudes slightly beyond the open end 34 of the split ferrule 32, and the dielectric insulator portion 22 and end segment 18*a* are received within the through chamber 50. The exposed segment 16*a* of the inner conductor 16 can then be engaged with a receptacle element of the mating port 12**.

Figure 6:
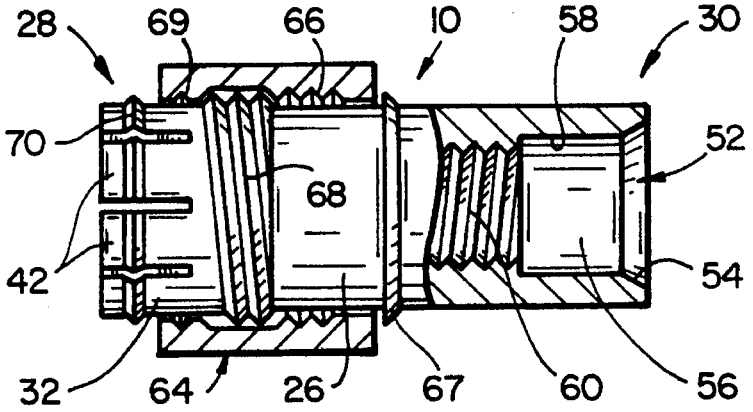
FIG. 6 is a partial sectional side view of one embodiment of the end connector with an external sheath in an unlocked position.
Figure 7:
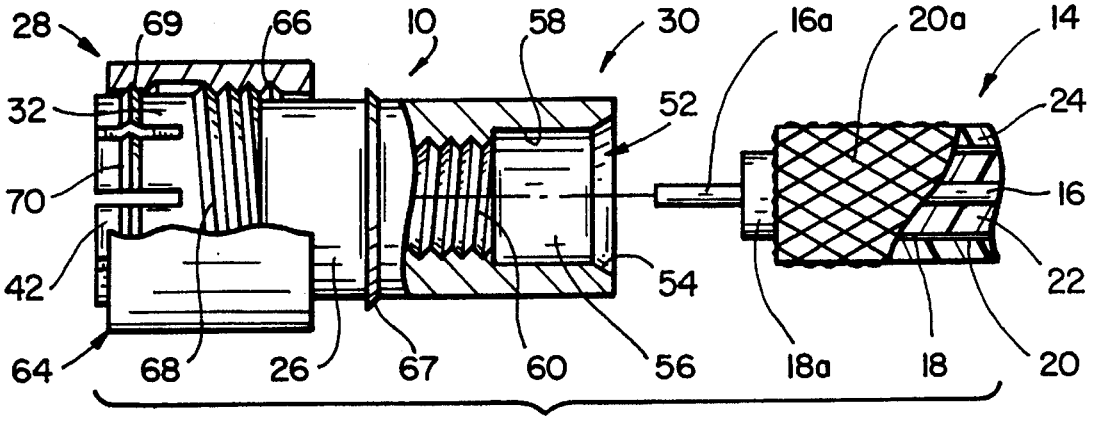
FIG. 7 is a partial sectional side view of the end connector illustrated in FIG. 6 with the external sheath in the locked position for installing the connector on a cable.

With reference now to FIGS. 6 and 7 and in accordance with another preferred embodiment of the present invention, the end connector 10, as previously described, is further provided with an external locking sheath 64 disposed about the front end portion 28. The locking sheath 64 is configured with an interiorly threaded surface 66 which is threadingly engaged with a threaded portion 68 provided on the outer surface of the split ferrule 32. The locking sheath 64 is axially displaced from an unlocked position, in which it is free to rotate when abutting stop member 67 as illustrated in FIG. 6, to a locked position as illustrated in FIG. 7. In FIG. 7, the locked position occurs by rotating the sheath 64 over the ferrule 32 until an interior circumferential locking channel 69 grasps an outwardly projected circumferential locking ring which is defined by outwardly arcuate projections 70 disposed on each of the resilient fingers 42 of the ferrule 32. When the sheath 64 is in the locked position as illustrated in FIG. 7, an inwardly directed or compressive force applies radial pressure to the fingers 42 of the ferrule 32 so as to enhance the grasping pressure on the mating port 12. Both the interiorly threaded surface 66 of the sheath 64 and the threaded portion 68 of the ferrule 32 are configured to require a minimum number of rotations to reach the locked position.

Figure 8:
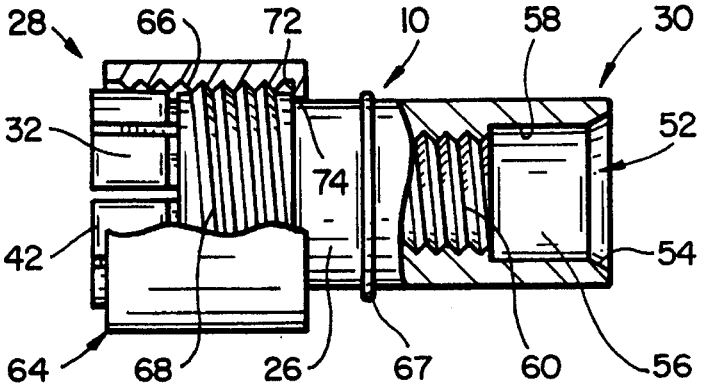
FIG. 8 is a partial sectional side view of another embodiment of the end connector with the external sheath in a locked position.
Figure 9:
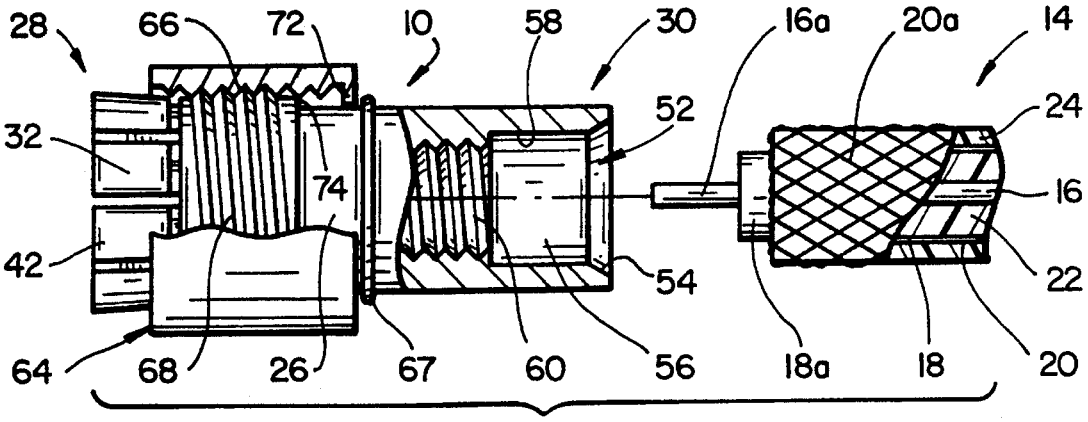
FIG. 9 is a partial sectional side view of the end connector illustrated in FIG. 8 with the external sheath in position for installing the connector on a cable.

With reference to FIG. 8 and 9 and in accordance with yet another embodiment of the present invention, the locked position occurs by rotating the sheath 64 over the ferrule 32 until an interior annular shoulder 72 abuts an annular shoulder 74 on the ferrule 32. When the sheath 64 is in the locked position as illustrated in FIG. 8, an inwardly directed or compressive force applies radial pressure to the fingers 42 of the ferrule 32 so as to enhance the grasping pressure on the mating port 12.

With reference to FIG. 9, the locking sheath 64 is prevented from freely rotating in an unlocked position so that the sheath 64 can be used to thread the connector 10 onto the cable 14. The locking sheath 64 is configured with an interiorly threaded surface 66 which is continually threadingly engaged with a threaded portion 68 provided on the outer surface of the split ferrule 32. The locking sheath 64 is axially displaced from an unlocked position, where it is prevented from freely rotating when abutting stop member 67, to a locked position. It is contemplated that stop member 67 can be any means to prevent the sheath 64 from rotating such as a band, step, pin, dowel, key, set screw, etc. The sheath 64 is placed over the split ferrule 32, then the stop member may be welded to the outer surface of the connector, be machined, or attached to the connector in any number of conventional means. When the sheath 64 is prevented from rotating by stop member 67, the sheath 64 can be used to rotate the connector 10 onto the cable 14 by force exerted on the stop member 67 and on the threads in the threaded portion 68. The internally threaded portion is illustrated as conventional threads, but it is also contemplated that the threads may be reverse turning threads.

It will be appreciated by those of ordinary skill in the art, that various modifications and combinations of the front and rear end portions of the described end connector are considered within the scope of the present invention. For example, a further embodiment of the present invention provides an end connector 10 with a conventional threaded nut for threading the end connector 10 onto the mating port 12 at the front end portion 28 and a rear end portion 30 which includes the threaded portion 60 and the non-threaded chamber 56 as described with reference to FIG. 2. A still further embodiment of the present invention provides an end connector 10 configured such that an externally threaded portion on the rear end portion 30 of the connector 10 burrows in between the dielectric insulator 22 and the outer conductor 18.

A still further embodiment of the present invention provides an end connector 10 with conventional threads in the interior threaded portion 60 and reverse turning threads for the interiorly threaded surface 66 of the sheath 64 and the threaded portion 68 of the ferrule 32. In other words, the interiorly threaded portion 60 is conventional threads, the threads 66 of the sheath 64 are reverse turning threads and the sheath locks when rotated counter-clockwise. The important aspect being that the threads in the interiorly threaded portion 60 of the end connector 10 and the threads 66 of the sheath 64 turn in opposite directions relative to each other.

A still further embodiment provides a sheath 64 that slides longitudinally over the outer surface of the ferrule 32 between an unlocked and a locked position, and a rear end portion 30 which includes the threaded portion 60 and the non-threaded chamber 56 as described with reference to FIG. 2. The interior of the longitudinally sliding sheath is configured to slide along a projection on the outer surface of the ferrule 32. The projection on the outer surface of the ferrule 32 prevents the sheath 64 from being rotated axially, so that the sheath 64 can be grasped and used to thread the connector 10 onto the cable 14.

While the invention has been described with reference to the foregoing embodiments, changes and variations may be made thereto which are within the scope of the appended claims. All such modifications or changes are intended to be included within the scope of the claims.

I claim:

1. An improved end connector of a type having a unitary tubular body having a rear end portion, a front end portion larger in diameter than said rear end portion whereby the larger diameter creates a longer moment arm, a port attachment means associated with said front end portion for connecting said connector to a mating port, and having an interiorly threaded portion associated with said rear end portion for attaching said end connector to a coaxial cable, the improvement comprising:

left handed threads in said interiorly threaded portion for attaching said end connector to an outer conductor of the coaxial cable using the longer moment arm to create greater torque.

2. The improved end connector of claim 1 wherein the threaded portion is in an interior of the rear end portion and the improvement further comprises a non-threaded interior portion that precedes said interiorly threaded portion at said rear end portion of said unitary tubular body.

3. The improved end connector of claim 1 wherein said port attachment means includes inward arcuate projections defining a circumferential ridge adapted to engage the mating port.

4. The improved end connector of claim 2 wherein the improvement further comprises a tapered portion that precedes said non-threaded interior portion and is adjacent a rear end opening at said rear end portion of said unitary tubular body.

5. An improved end connector of a type having a unitary tubular body having a rear end portion, a front end portion larger in diameter than said rear end portion, a port attachment means associated with said front end portion for connecting said connector to a mating port, a sheath disposed about said front end portion and threadingly engaged with an outer surface of said front end portion so as to be axially displaced along said front end portion between an unlocked position and a locked position and having an interiorly threaded portion associated with said rear end portion for attaching said end connector to a coaxial cable, the improvement comprising:

left handed threads in said interiorly threaded portion for attaching said end connector to an outer conductor of the coaxial cable.

6. The improved end connector of claim 5 wherein said port attachment means includes inward arcuate projections defining a circumferential ridge adapted to engage the mating port.

7. The improved end connector of claim 5 wherein the improvement further comprises a non-threaded interior portion that precedes said left handed threads at said rear end portion of said unitary tubular body.

8. The improved end connector of claim 6 wherein the improvement further comprises a tapered portion that precedes said non-threaded interior portion and is adjacent a rear end opening at said rear end portion of said unitary tubular body.

9. An end connector for connecting a coaxial cable to a mating port, comprising:

a unitary tubular body having a rear end portion and a front end portion larger in diameter than said rear end portion whereby the larger diameter creates a longer moment arm;

a port attachment means associated with said front end portion for attaching said end connector to the mating port; and a cable attachment means associated with said rear end portion for attaching said connector to an outer conductor of the coaxial cable, said cable attachment means includes an interiorly threaded portion having left handed threads for attaching said end connector to the coaxial cable using the longer moment arm to create greater torque.

10. The end connector of claim 9, wherein said port attachment means includes inward arcuate projections defining a circumferential ridge adapted to engage the mating port.

11. The end connector of claim 9, further comprising a sheath disposed about said front end portion and threadingly engaged with an outer surface of said front end portion so as to be axially displaced along said front end portion between an unlocked position and a locked position.

12. The end connector of claim 9, wherein said cable attachment means further comprises interior threads in said threaded portion and a non-threaded interior portion that precedes said left handed threads and is adjacent a rear end opening at said rear end portion of said unitary tubular body.

13. The end connector of claim 9, further comprising a sheath disposed about said front end portion of said unitary tubular body, said sheath adapted to engage an outer surface of said front end portion.

14. The end connector of claim 13, wherein said cable attachment means further comprises interior threads in said threaded portion and a non-threaded interior portion that precedes said left handed threads and is adjacent a rear end opening at said rear end portion of said unitary tubular body.

15. An end connector for connecting a coaxial cable to a mating port, comprising:

a unitary tubular body having a rear end portion and a front end portion larger in diameter than said rear end portion whereby the larger diameter creates a longer moment arm;

a cable attachment means associated with said rear end portion for attaching said connector to said cable, said cable attachment means comprises an interior left hand threaded portion of said unitary tubular body which is preceded by a non-threaded interior portion of said unitary tubular body that is adjacent a rear end opening at said rear end portion of said unitary tubular body;

a port attachment means associated with said front end portion for attaching said connector to said mating port, said port attachment means comprising a split ferrule defining a plurality of resilient fingers; and a sheath disposed about said front end portion of said unitary tubular body, said sheath being threadingly engaged with an outer surface of said split ferrule so as to be axially displaced along said ferrule between an unlocked position and a locked position in which said sheath contacts said fingers, wherein said sheath is adapted to restrict the resiliency of said resilient fingers when engaged in said locked position.

16. The end connector of claim 15, wherein said fingers include inward arcuate projections defining a circumferential ridge adapted to engage said mating port.

17. The end connector of claim 15, further comprising a tapered portion of said unitary tubular body which precedes said non-threaded portion and is adjacent said rear end opening.

18. An end connector for connecting a coaxial cable to a mating port, comprising:

a unitary tubular body having a rear end portion and a front end portion larger in diameter than said rear end portion whereby the larger diameter creates a longer moment arm;

a cable attachment means associated with said rear end portion for attaching said connector to said cable, said cable attachment means comprises an interiorly threaded portion of said unitary tubular body which is preceded by a non-threaded portion of said unitary tubular body that is adjacent a rear end opening at said rear end portion of said unitary tubular body;

a port attachment means associated with said front end portion for attaching said connector to said mating port, said port attachment means comprising a split ferrule defining a plurality of resilient fingers; and a sheath disposed about said front end portion of said unitary tubular body, said sheath having threads that turn opposite from said interiorly threaded portion of said unitary tubular body and being threadingly engaged with an outer surface of said split ferrule so as to be axially displaced along said ferrule between an unlocked position and a locked position in which said sheath contacts said fingers, wherein said sheath is adapted to restrict the resiliency of said resilient fingers when engaged in said locked position.

19. The end connector of claim 18, wherein said fingers include inward arcuate projections defining a circumferential ridge adapted to engage said mating port.

20. The end connector of claim 18, further comprising a tapered portion of said tubular body which precedes said non-threaded portion and is adjacent said rear end opening.

21. A method for attaching an end connector of a type having a unitary tubular body having a rear end portion and a front end portion larger in diameter than said rear end portion whereby the larger diameter creates a longer moment arm, a port attachment means associated with said front end portion for connecting said connector to a mating port, a sheath disposed about said front end portion of said unitary tubular body, said sheath having an interiorly threaded portion and being threadingly engaged with an outer surface of said split ferrule so as to be axially displaced along said ferrule between an unlocked position and a locked position, and a cable attachment means having an interiorly threaded portion having threads that turn opposite of said interiorly threaded portion of said sheath associated with said rear end portion for attaching said end connector to a coaxial cable, the method comprising:

connecting said cable attachment means of said end connector to the coaxial cable by turning said sheath toward said locked position.

22. The method of claim 21 wherein the connecting comprises threading said end connector onto the coaxial cable in a same direction as said interiorly threaded portion of said cable attachment means.

23. A method for attaching an end connector of a type having a unitary tubular body having a rear end portion, a front end portion larger in diameter than said rear end portion whereby the larger diameter creates a longer moment arm, a port attachment means associated with said front end portion for connecting said connector to a mating port, and a cable attachment means having an interiorly threaded portion having left handed threads associated with said rear end portion for attaching said end connector to an outer conductor of a coaxial cable, the method comprising:

connecting said cable attachment means of said end connector to the outer conductor of the coaxial cable by turning said end connector counter-clockwise using the longer moment arm to create greater torque.

24. The method of claim 23 wherein the connecting comprises threading said end connector onto outer conductor of the coaxial cable in a counter-clockwise direction.

25. The method of claim 24 wherein the connecting comprises rotating said front end portion of said end connector in a counter-clockwise direction so as to thread said cable attachment means onto the outer conductor of the coaxial cable.

* * * * *